US005701689A

United States Patent [19]

Hansen et al.

[11] Patent Number: 5,701,689

[45] Date of Patent: Dec. 30, 1997

[54] SNOWBOARD BOOT

[75] Inventors: Reinhard Hansen, Salzburg, Austria; Leon Widdison, Laufen, Germany; Wolfgang Wurm, St. Georgen, Austria

[73] Assignee: Goodwell International Limited, Tortola, Virgin Islands (Br.)

[21] Appl. No.: 539,599

[22] Filed: Oct. 5, 1995

[30] Foreign Application Priority Data

Oct. 7, 1994 [DE] Germany ..... 44 35 959.4

[51] Int. Cl.[6] ..... A43B 5/04

[52] U.S. Cl. ..... 36/115; 36/88; 36/116; 36/92

[58] Field of Search ..... 36/88, 89, 92, 36/115, 117, 117.1, 116

[56] References Cited

U.S. PATENT DOCUMENTS

| | | | |
|---|---|---|---|
| 459,616 | 9/1891 | Von Rohonczy | 36/89 |
| 2,660,812 | 12/1953 | Henke | 36/117 |
| 3,735,508 | 5/1973 | Gertsch et al. | 36/117.1 |
| 4,384,413 | 5/1983 | Bourque | 36/115 |
| 4,587,747 | 5/1986 | Courvoisier et al. | 36/117 |
| 4,769,929 | 9/1988 | Sartor | 36/117 |
| 5,291,671 | 3/1994 | Caberlotto et al. | 36/88 |
| 5,331,752 | 7/1994 | Johnson et al. | 36/115 |
| 5,408,761 | 4/1995 | Gazzano | 36/88 |
| 5,435,080 | 7/1995 | Meiselman | 36/115 |
| 5,499,461 | 3/1996 | Danezin et al. | 36/117 |

FOREIGN PATENT DOCUMENTS

| | | | |
|---|---|---|---|
| 0057170 | 8/1982 | European Pat. Off. | 36/115 |
| 0 64334 A1 | 9/1994 | European Pat. Off. | A43B 5/04 |
| 49631 | 5/1939 | France | 16/4 |
| 1589384 | 3/1970 | France . | |
| 2702935 | 9/1994 | France | 36/115 |
| 1195637 | 6/1965 | Germany . | |
| WO 94/21149 | 9/1994 | WIPO | A43B 5/04 |

*Primary Examiner*—M. D. Patterson

*Attorney, Agent, or Firm*—Senniger, Powers, Leavitt & Roedel

[57] ABSTRACT

The snowboard boot having a flexible shaft that consists of a soft, padded material. Originating from the sole-proximal center or toe region, a strap which has low flexibility in the longitudinal direction extends around the rear side of the shaft within its upper, sole-distant region and back to the sole-proximal center or toe region of the other side. Similarly, a second strap extends from the sole-proximal heel region over the instep of the boot. The length of both straps can be adjusted.

16 Claims, 4 Drawing Sheets

SNOWBOARD BOOT

BACKGROUND OF THE INVENTION

Currently, there exist two basic types of snowboard boots: hard-shell boots which consist of a relatively hard, inflexible plastic shell that is constructed similar to the one of conventional ski boots and a padded inner shoe; and so-called soft boots which are very soft and flexible because their outer casing consists of a textile or soft leather. The aforementioned hard-shell boots provide an acceptable support for the foot in all directions and are mostly used in connection with a so-called plate binding that overlaps the sole projections arranged within the toe and heel region of the boot with a bracket. However, the excellent support of this boot can only be attained by accepting the disadvantage of low flexibility and, unfortunately, poor wearing comfort.

In addition, the hard shell results in a relatively high weight for these boots, i.e., the wearing comfort is additionally reduced. Due to their low flexibility, these boots are not used by so-called free-style snowboarders who execute intricate jumps or perform artistic routines. These free-style snowboarders prefer the aforementioned soft boots which ensure very high flexibility in all directions, provide superior wearing comfort and have low weight. When snowboarding, it is, however, quite important to apply pressure to the front or rear edge of the snowboard. When using hard-shell boots, this pressure is primarily transmitted to the snowboard via the shin, the shaft of the boot, the sole of the boot, and the binding without excessively stressing the ankle of the snowboarder. When using the more flexible "soft boots," the ankle, the tendons and the muscles of the snowboarder are stressed much more strongly than with hard-shell boots when applying pressure onto one of the edges of the snowboard. This is the reason why these "soft boots" are normally only used in connection with so-called shell bindings. These shell bindings comprise a relatively hard shell that accommodates the boot. This shell is, primarily within the region of the shaft which points toward the rear, provided with a support element and holds the boot in the binding with several straps that extend over the front region and the remainder of the boot. However, these bindings are difficult to handle, limit flexibility, and have a relatively high weight.

SUMMARY OF THE INVENTION

The invention is based on the objective of developing a snowboard boot that ensures superior support for the foot in order to apply pressure to the front or rear edge of the snowboard, provides superior wearing comfort, and has low weight.

Briefly, therefore, the invention is directed to a snowboard boot of the type having a sole and a flexible shaft of a soft, padded material, the shaft having a forwardly facing exterior, a rearwardly facing exterior, and an upper terminus, the boot having an instep, a heel and a toe, and successively between the heel and toe, a heel region, a center region forward of the heel region, and a toe region forward of the center region, each of the heel region, center region and toe region occupying relatively equal lengths of the boot's sole, the boot having a first side on one side of a line between its heel and toe and a second side on the other side of a line between its heel and toe. The boot comprises a first strap which has low flexibility in the longitudinal direction and which extends from a location on its first side which is forward of the heel region and proximate the sole, around the rearwardly facing exterior of the shaft below its upper terminus, and back to a location on its second side which is forward of the heel region and proximate the sole.

Advantageous embodiments and developments of the invention are disclosed in the subclaims.

BRIEF DESCRIPTION OF THE DRAWINGS

The invention is described more specifically below on the basis of an embodiment example in connection with the drawings. Of these.

In the individual figures, the same reference numerals identify identical components or components with a corresponding function.

DETAILED DESCRIPTION OF THE PREFERRED EMBODIMENTS

The snowboard boot according to the invention combines the advantages of the hard-shell boot with those of the "soft boot" while eliminating their respective disadvantages. Consequently, this snowboard boot can also be used in connection with a plate binding, i.e., it can also be used for snowboarding on hard or icy slopes. In particular, the snowboard boot according to the invention provides the exceptional wearing comfort of a soft boot and the superior support of a hard-shell boot.

Figure 1:
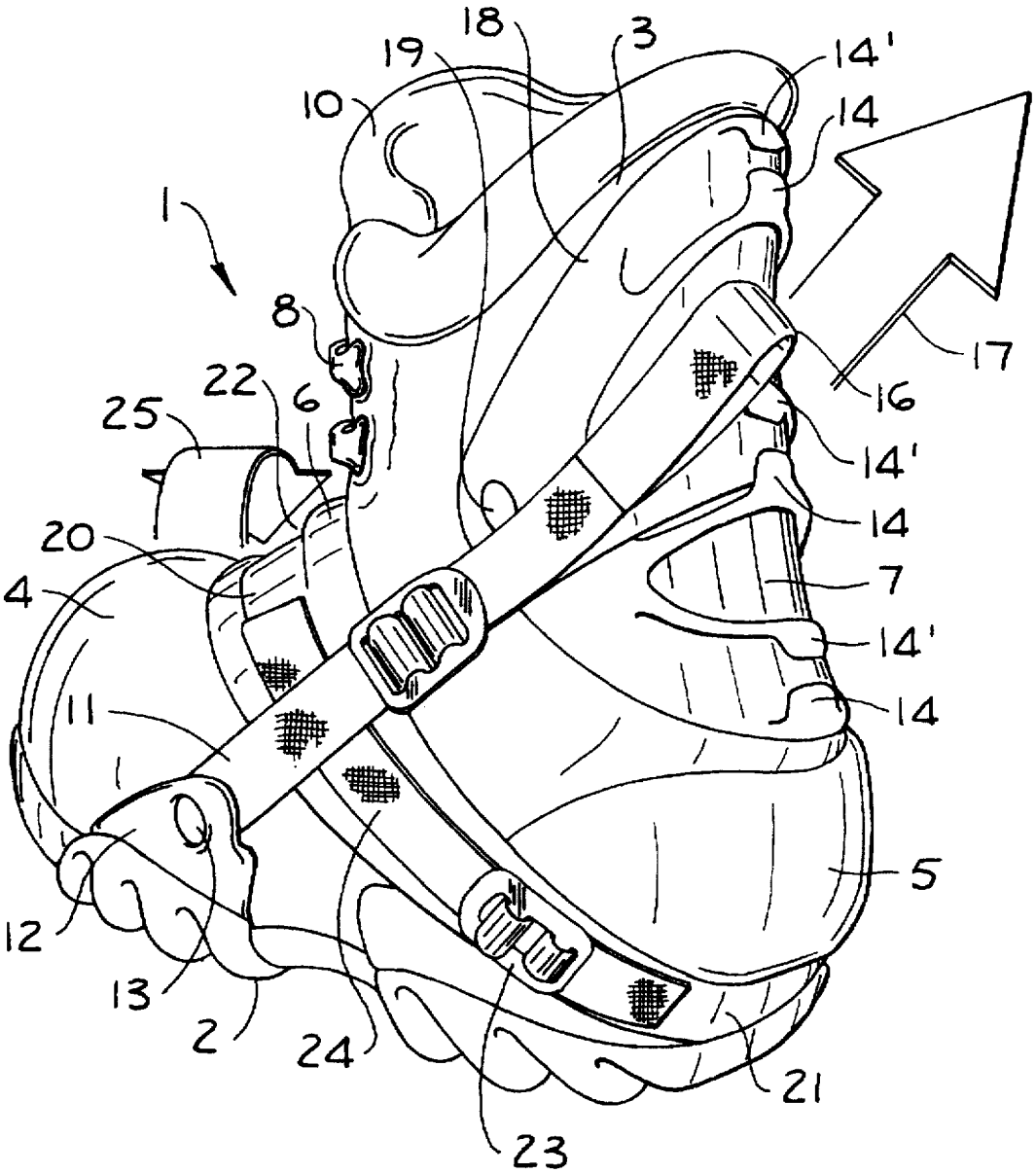
FIG. 1: a perspective representation of the outer ankle side of a snowboard boot according to the invention.

Referring to FIG. 1, the snowboard boot 1 has a rubber sole 2, a shaft 3, a toe region 4 that covers the front of the foot and the toes, a heel region 5 that encloses the heel of the foot and an instep region 6. The rear side of the shaft 3 which points toward the rear is identified by reference numeral 7. This snowboard boot is fastened by laces as is the case with most soft boots. For this purpose, conventional eyelets 8 that hold the shoelaces 9 (FIG. 2) are provided within the front shaft region. This boot is manufactured of a soft, flexible material or a textile fabric. It has a soft, padded interior as well as a soft, padded tongue 10.

According to the invention, the boot comprises a first strap 11 that is fastened onto the outside in the vicinity of the sole 2, namely, on both sides within the region of the front of the foot. The strap extends from a location which is forward of the heel region, that is, in the central or toe region, and proximate the sole on the first side of the boot, around the rearwardly facing exterior of the shaft below its upper terminus, and back to a location which is forward of the heel region and proximate the sole on the second side of the boot. In the embodiment according to FIG. 1, this is realized by means of a clasp 12 that is connected to the sole and a pivoted fastening arrangement 13, e.g., in the form of rivets. The strap extends around the rear side 7 of the shaft, i.e., within its upper region, and is fixed with respect to its height by means of securing devices 14 and 14' such that said strap can neither slide toward the bottom in the direction toward the sole nor toward the top in the direction toward the opening of the shaft. Although the strap 11 is flexible, it only has a very low flexibility and extensibility in its longitudinal direction such that it supports the shaft 3, absorbs forces that are directed toward the rear, e.g., forces that occur when applying pressure onto the rear edge of the snowboard, and introduces said forces into the sole 2 within the region of the front of the foot. This strap supports the shaft against rearward movement. The preferred material is a belt of woven textile material, but the strap may be made from other materials, such as plastic. The strap's longitudinal stretch or elongation is preferably less than about 10%. One preferred strap has a longitudinal stretch in use of less than about 1%.

In this case, the securing devices 14 and 14' consist of two hooks that point toward one another, with the strap 11 being secured in said hooks. Several such securing devices 14, 14' are provided on the rear side of the boot at different elevations with reference to the sole 2 of the boot. In the embodiment according to FIG. 1, a total of three such securing devices is provided. This measure makes it possible to vary the flexibility of the boot.

A buckle 15 is provided for adjusting the length of the strap 11. Part of the strap 11 is rigidly connected to this buckle, while another part of the strap is threaded through said buckle such that it ends in a loop 16. This loop 16 is realized in such a way that the strap 11 can be shortened by pulling the strap in the direction of the arrow 17, i.e., transversely upward. The so-called "forward angle" of the boot shaft can be variably altered and consequently adapted to the respective snowboarding requirements by adjusting the length of this strap.

In order to distribute the pressure of the strap onto the shaft 3 in a more uniform fashion, a reinforcing element 18 is inserted between the shaft 3 and the strap 11 within the region of the rear side of the shaft. This reinforcing element consists of a harder material or plastic and transmits the pressure of the strap 11 onto the rear side 7 of the shaft 3 via a larger surface. On the rear side 7 of the shaft 3, this reinforcing element 18 extends upward to the end of the shaft 3, laterally forward on both sides and is fastened at this location by means of a rivet 19. This rivet 19 acts as a pivot bearing such that the reinforcing element 18 is also able to follow the movements of the shaft 3 to a limited extent and only stiffens said shaft insignificantly. The primary function of this reinforcing element 18 is the pressure distribution over a larger surface.

A second strap 20 is provided in analogous fashion for applying pressure onto the front edge of the snowboard. Within the region of the heel part 5, this second strap is fastened in the vicinity of the sole 2 and extends transversely upward over the instep region 6 on both sides. The instep of the foot is raised once the snowboarder applies pressure onto the front of the foot so as to exert a force onto the front edge of the snowboard. This pressure is transmitted into the sole region on the side of the heel and consequently onto the binding by the strap 20. The strap 20 is fastened slightly above the sole within a fastening region 21. Within this region, the strap can be bonded, riveted or fastened by any other means, e.g., by being threaded through an opening as shown in FIG. 1. In order to fix the second strap 20 within the instep region in superior fashion, a depression 22 is provided at this location, with said depression being adapted to the width of the strap 20 and securing said strap from being displaced.

The length of the second strap 20 can also be adjusted, i.e., with a buckle 23, through which one end of the strap is threaded. In this case, the free end 24 of the strap 20 extends transversely upward in the direction toward the instep 6 such that the strap can be shortened by pulling it transversely upward in the direction of the arrow 25. Due to this measure, the foot is held in a superior fashion by the pressure applied onto the instep and firmly pressed against the inner sole of the shoe within the heel region such that the very unpleasant lifting of the heel in the interior of the shoe is prevented. On the other hand, as previously mentioned, the forces are transmitted to the sole and subsequently to the binding in superior fashion.

In the embodiment according to FIG. 1, the straps 11 and 20 intersect such that the free end 24 of the strap 20 is also held by the strap 11.

Figure 2:
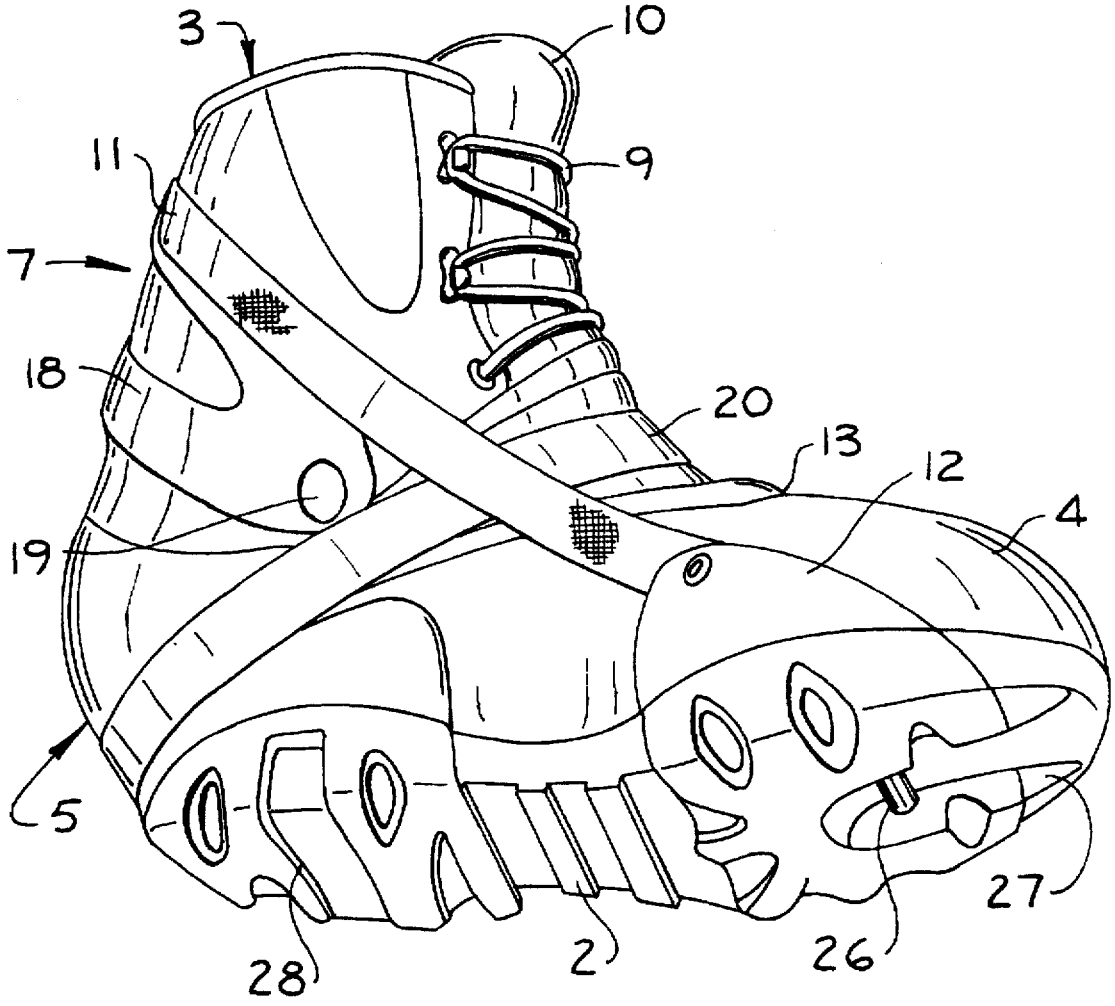
FIG. 2: a perspective representation of the inner ankle side of the snowboard boot.

FIG. 2 shows the same snowboard boot from a different viewing angle. This figure also shows that the fastening element 18 is fastened onto the rivet 19 via a slot such that a superior flexibility for bending the shin forward is ensured.

In addition, FIG. 2 shows that this boot can also be fastened inside of a plate binding that is the object of a different patent application by the applicant with the aid of binding components that are integrated into the sole 2. For this purpose, a recess 27 is provided in the sole within the region of the front of the foot. A bolt 26 that extends transverse to the longitudinal axis of the shoe is inserted into the aforementioned recess. The shoe can be inserted and fixed in a hook of the binding with this bolt. Lateral catch openings 28, into which corresponding components of the binding engage, are provided within the heel region of the sole. Consequently, this snowboard boot can be exclusively fastened in the binding via the sole 2, i.e., all disadvantages of the shell bindings used thus far are eliminated.

Figure 4:
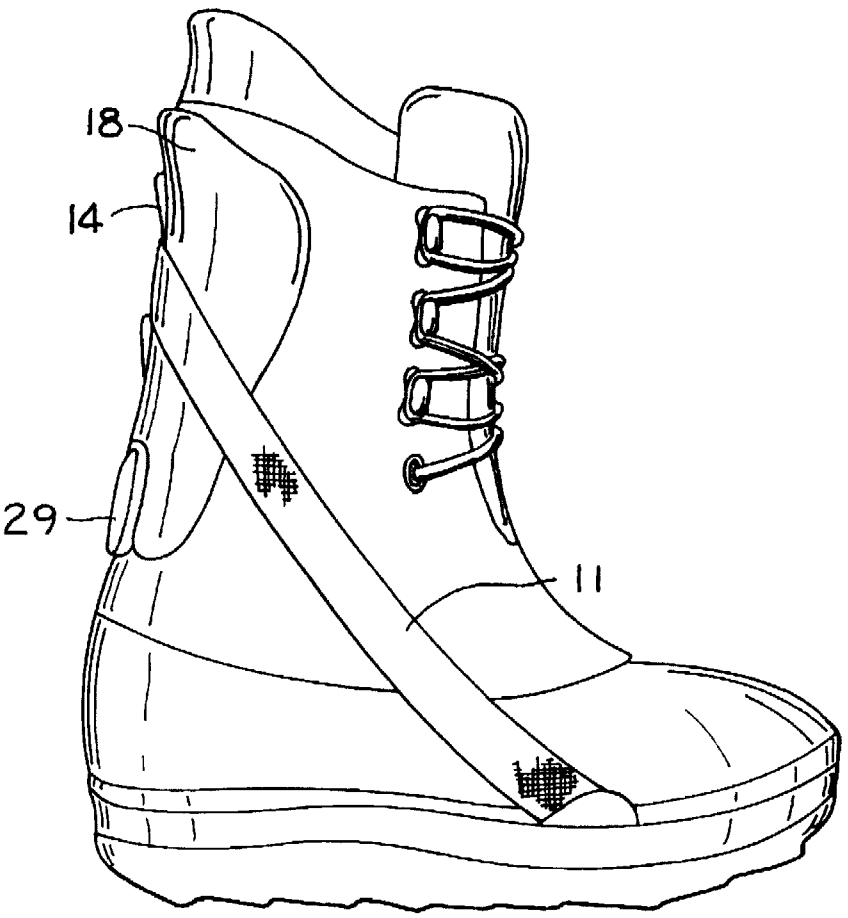
FIG. 4, a schematic representation of a snowboard boot according to a third variation.
Figure 3:
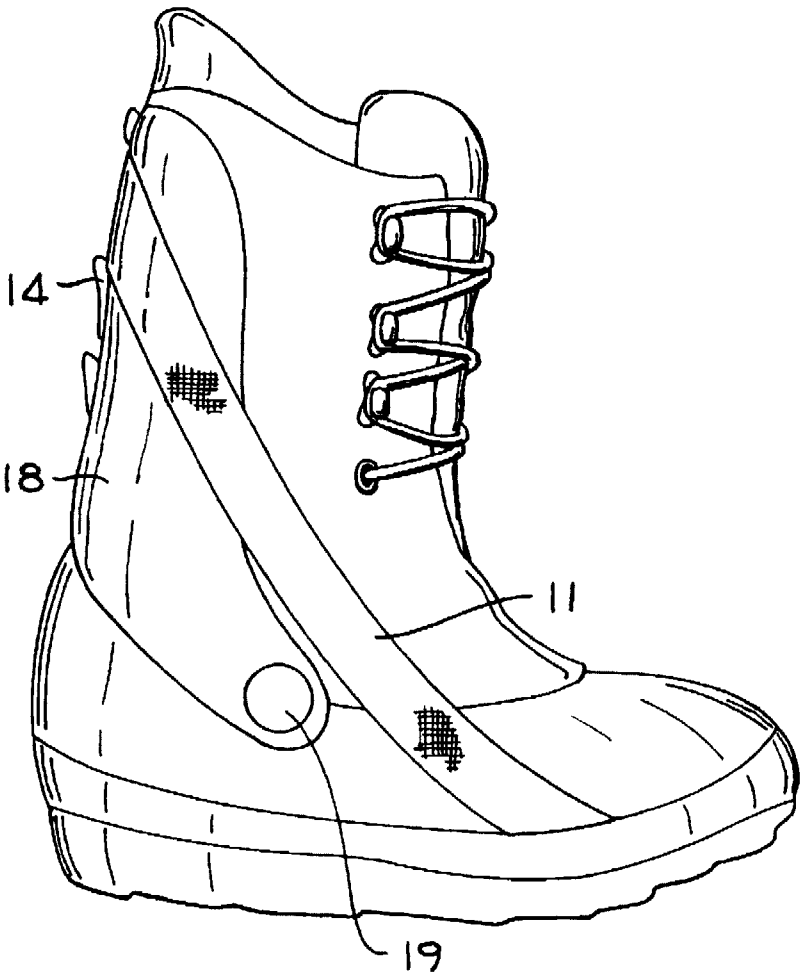
FIG. 3: a schematic representation of a snowboard boot according to a second variation of the invention.

FIGS. 3 and 4 show two different variations of the reinforcing element 18. In FIG. 1, the fastening of this element is realized via the rivet 19 that is situated approximately in the center of the reinforcing element 18. In the embodiment according to FIG. 3, the fastening element has, if viewed from the side, the approximate shape of a L, with the two arms of the "L" being arranged at an obtuse angle and the rivet 19 being arranged at the lowest point of the reinforcing element. When "leaning backward," the pressure is absorbed approximately in the center of the boot via the strap 11 and the reinforcing element 18. In addition, this type of construction also provides a certain support for the lateral bending of the ankle, as may be desired by certain snowboarders.

In the variation according to FIG. 4, the reinforcing element 18 does not extend laterally around the shaft quite as far and comprises a U-shaped recess on its underside. A limit stop 29 that is connected to the shaft 3 and prevents an additional bending of the shaft toward the rear as soon as the recess of the reinforcing element 18 comes in contact with said limit stop is provided in the aforementioned U-shaped recess.

Figure 5:
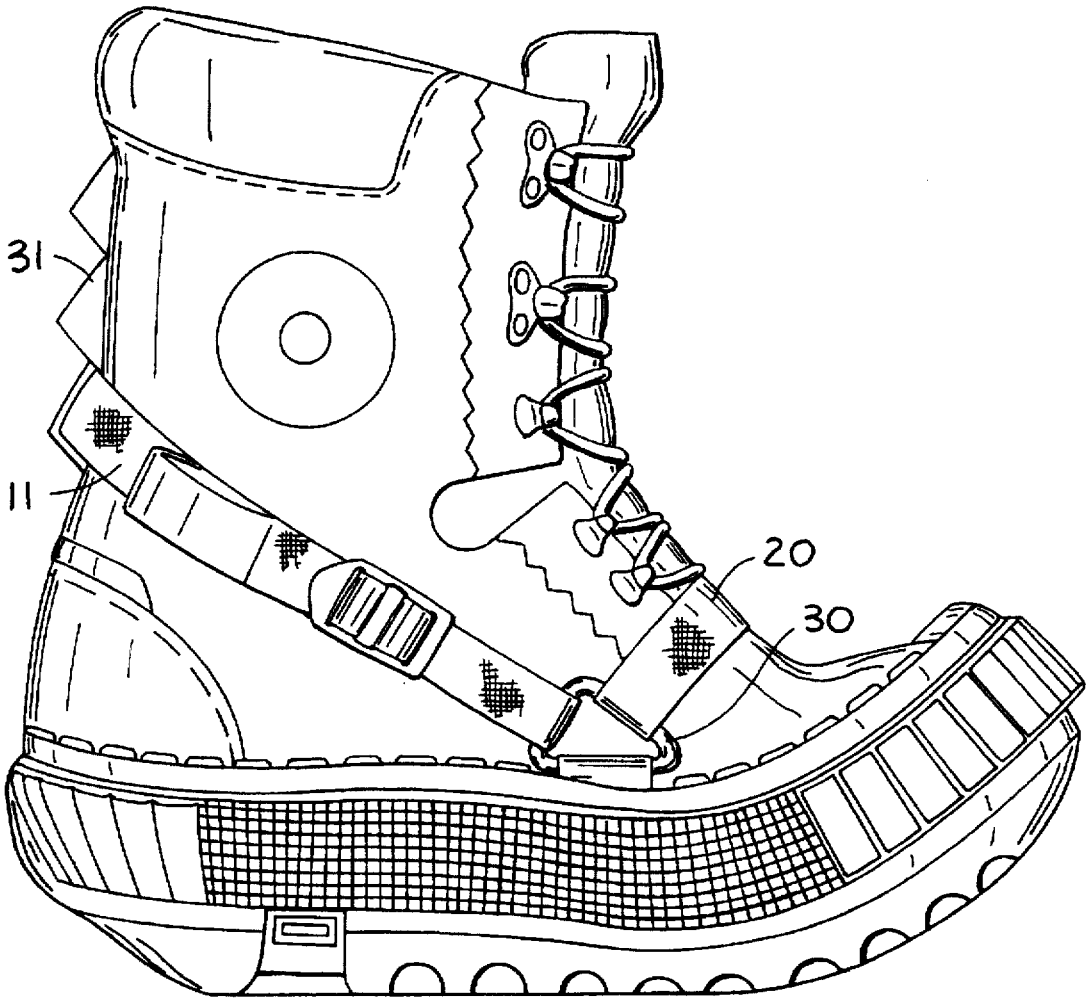
FIG. 5, a side view of a snowboard boot according to a fourth variation of the invention.

FIG. 5 shows one additional variation of the strap arrangement. In this case, both straps 11 and 20 are fastened at one common point that is realized in the form of an eyelet 30 and, in contrast to the embodiments according to FIGS. 1 and 2, situated further toward the rear, i.e., displaced from the front of the foot region into the center region of the foot. FIG. 5 also shows a different variation of the securing device for the strap 11. For this purpose, sawtooth-like projections with openings 31, through which the strap 11 is threaded, are provided on the rear side of the shaft.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A snowboard boot for use with a snowboard, said boot comprising:

a sole;

an upper mounted on the sole and having a toe portion, an instep portion, a heel portion and a shaft extending upward from the heel portion, said upper having an exterior constructed of a flexible material and an interior constructed of a soft, padded material such that the shaft is capable of flexing movement relative to the sole in directions transverse to the sole;

a strap extending generally between the rear of the shaft and the sole, which strap is connected to the rear portion of the shaft and the sole free of force transmitting engagement with the upper between the rear of the shaft and the sole; and a reinforcing element interposed between the strap and the rear of the shaft and being everywhere spaced apart from the sole of the boot with the flexible material of the upper everywhere interposed between the reinforcing element and the sole to allow flexing movement of the shaft relative to the sole in directions transverse to the sole.

2. The snowboard boot according to claim 1 wherein said reinforcing element is connected to the upper.

3. The snowboard boot according to claim 1 further comprising a limit stop for limiting rearward bending of the shaft relative to the sole.

4. The snowboard boot according to claim 3 wherein said limit stop is mounted on the exterior of the upper below the reinforcing element.

5. A snowboard boot for use with a snowboard, said boot comprising:

a sole;

an upper mounted on the sole and having a toe portion, an instep portion, a heel portion and a shaft extending upward from the heel portion, said upper having an exterior constructed of a flexible material and an interior constructed of a soft, padded material such that the shaft is capable of flexing movement relative to the sole in directions transverse to the sole;

a strap extending generally between the rear of the shaft and the sole, which strap is engaged with the rear portion of the shaft and the sole;

a reinforcing element interposed between the strap and the rear of the shaft and being everywhere spaced apart from the sole of the boot to allow flexing movement of the shaft relative to the sole in directions transverse to the sole; and a clasp attached to the sole forward of the heel portion of the upper and extending transversely beneath the sole, the strap being connected to the clasp for operatively engaging the sole.

6. The snowboard boot according to claim 5 further comprising means for adjusting the length of said strap.

7. The snowboard boot according to claim 5 further comprising a securement connected to the boot for preventing the strap from sliding downward along the rear of the shaft toward the sole.

8. The snowboard boot according to claim 7 further comprising a plurality of securements for said strap, said securements being spaced apart vertically along the rear of the shaft.

9. The snowboard boot according to claim 7 further comprising a securement connected to the boot for preventing the strap from sliding upward along the rear of the shaft toward the top of the boot.

10. The snowboard boot according to claim 5 wherein said strap is a first strap, said boot further comprising a second strap extending generally between the instep portion of the upper and the sole, the second strap being operatively engaged with the instep portion of the upper and the sole so that the second strap transmits forces applied to the second strap from the instep portion of the upper to the sole for use in controlling the snowboard.

11. The snowboard boot according to claim 10 further comprising means for adjusting the length of said second strap.

12. The snowboard boot according to claim 10 further comprising a guide for the second strap within the instep portion of the upper.

13. The snowboard boot according to claim 12 wherein said guide comprises a depression within the instep portion of the upper.

14. The snowboard boot according to claim 10 wherein said first and second straps operatively engage the sole at a single location proximate the instep portion of the upper.

15. The snowboard boot according to claim 5 further comprising a clasp attached to the sole forward of the heel portion of the upper and extending transversely beneath the sole, the strap being connected to the clasp for operatively engaging the sole.

16. The snowboard boot according to claim 15 wherein the strap is attached to the clasp by a pivot bearing.

* * * * *